US006963313B2

(12) United States Patent
Du

(10) Patent No.: US 6,963,313 B2
(45) Date of Patent: Nov. 8, 2005

(54) DUAL BAND SLEEVE ANTENNA

(75) Inventor: Xin Du, Schaumburg, IL (US)

(73) Assignee: PCTEL Antenna Products Group, Inc., Bloomingdale, IL (US)

( * ) Notice: Subject to any disclaimer, the term of this patent is extended or adjusted under 35 U.S.C. 154(b) by 0 days.

(21) Appl. No.: 10/707,490

(22) Filed: Dec. 17, 2003

(65) Prior Publication Data

US 2005/0134516 A1 Jun. 23, 2005

(51) Int. Cl.[7] ..... H01Q 9/04
(52) U.S. Cl. ..... 343/790; 343/791; 343/792
(58) Field of Search ..... 343/790, 791, 343/792

(56) References Cited

U.S. PATENT DOCUMENTS

| | | | | |
|---|---|---|---|---|
| 3,293,646 A | * | 12/1966 | Brueckmann | 343/750 |
| 4,369,449 A | | 1/1983 | MacDougall | 343/790 |
| 4,509,056 A | | 4/1985 | Ploussios | 343/791 |
| 5,079,562 A | | 1/1992 | Yarsunas et al. | 343/792 |
| 5,231,412 A | | 7/1993 | Eberhardt et al. | 343/790 |
| 5,565,880 A | | 10/1996 | Wang et al. | 343/791 |
| 5,668,564 A | | 9/1997 | Seward et al. | 343/791 |
| 5,719,587 A | | 2/1998 | Rodal | 343/791 |
| 5,812,097 A | | 9/1998 | Maldonado | 343/790 |
| 5,969,684 A | | 10/1999 | Oh et al. | 343/702 |
| 6,034,648 A | * | 3/2000 | Hope | 343/790 |
| 6,054,962 A | | 4/2000 | Ha et al. | 343/722 |
| 6,075,488 A | | 6/2000 | Hope | 343/702 |
| 6,177,911 B1 | | 1/2001 | Yuda et al. | 343/792 |
| 6,239,768 B1 | | 5/2001 | Oh et al. | 343/895 |
| 6,552,692 B1 | | 4/2003 | Zeilinger et al. | 343/792 |

* cited by examiner

*Primary Examiner*—Hoang V. Nguyen
(74) *Attorney, Agent, or Firm*—Babcock IP, LLC

(57) ABSTRACT

A cost efficient multi-band antenna, for use with non-harmonically related frequency bands, for example dual Wi-Fi frequency bands. An antenna element extends away from a ground plane. A sleeve positioned coaxial about the antenna element is spaced apart from the antenna element and the ground plane. Dimensions, spacing and dielectric constants of the antenna element, sleeve and any dielectric spacers are selected to tune the antenna to the desired frequency bands. Further, the ground plane may be the radiating element of, for example a GPS module or SDAR antenna to create a triple frequency band antenna assembly.

15 Claims, 6 Drawing Sheets

DUAL BAND SLEEVE ANTENNA

BACKGROUND OF INVENTION

1. Field of the Invention

The invention relates to dual-band antennas. More specifically, in a preferred embodiment, the invention relates to a cost efficient antenna tunable for use with both 802.11a and 802.11b/g "Wi-Fi" frequency bands.

2. Description of Related Art

Digital wireless systems, for example wireless local area computer networks, utilize frequency bands allocated for use by specific communication protocols. To provide users with increased connectivity options, it is desirable to provide multiple protocol capability. Because the standardized "Wi-Fi" protocols are not allocated to frequency bands that are harmonically related to each other, it has been difficult to provide a cost effective single antenna solution with acceptable dual band performance.

Sleeve chokes are a known method for tuning a whip and or dipole antenna. Typically the choke is a ¼ wavelength sleeve a distal end coupled to an outer conductor of a coaxial feed or a proximal end of the inner conductor. The inner conductor of the coaxial feed forms an antenna element that extends beyond the sleeve for ¼ wavelength of the target frequency. Because the choke and the extending antenna element are both ¼ wavelength of the target frequency, it is difficult to tune the resulting antenna to dual bands that are not harmonically related.

To achieve acceptable dual band performance, prior dual band antenna configurations have used multiple concentric and or mechanically interconnected at one end sleeve/choke assemblies. However, these configurations have increased cost and manufacturing tolerance requirements. Further, the resulting antenna has an increased diameter to accommodate the additional concentric sleeve(s).

Competition within the antenna industry has focused attention on dual band capability within a single antenna, minimization of antenna size, materials and manufacturing costs.

Therefore, it is an object of the invention to provide an antenna, which overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
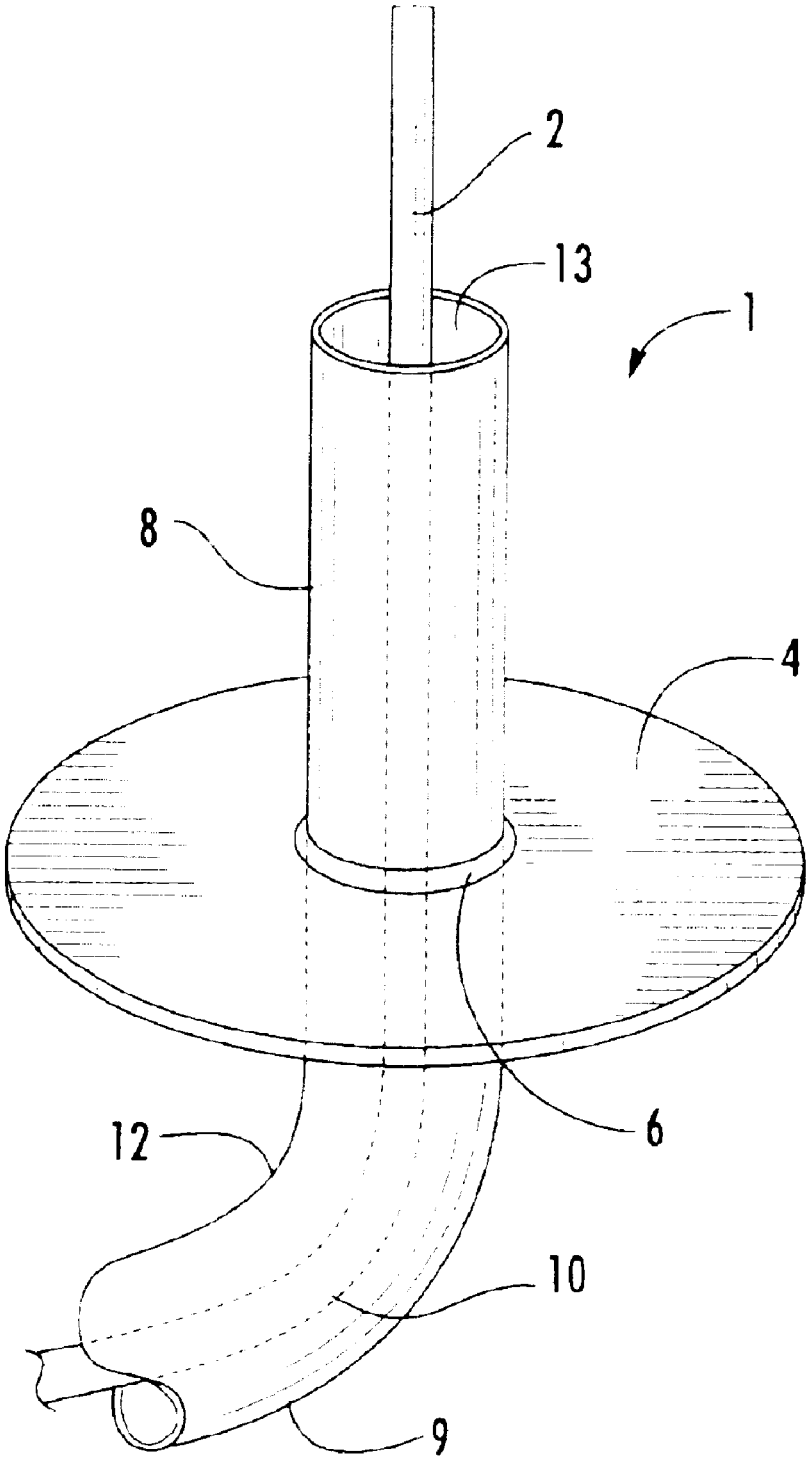
FIG. 1 shows an external isometric view of a first embodiment of the invention.

A first embodiment of the antenna 1 is shown in FIG. 1. An antenna element 2 is fed through an aperture in a ground plane 4 upon which, insulated by a dielectric spacer 6 a sleeve 8 is supported generally concentric about the antenna element 2. The antenna 1 may be fed, for example, by a coaxial cable 9 having an inner conductor 10 coupled to the antenna element 2 and an outer conductor 12 coupled to the ground plane 4.

In the preferred embodiment, the sleeve 8 has a simple tubular configuration without annular radiuses or other electrically interconnecting structure previously applied to prior "choke" elements. The sleeve element 8 is electrically insulated by the dielectric spacer 6 from direct contact with the ground plane 4 and by the air gap 13 differential between the outer diameter of the antenna element 2 and the inner diameter of the sleeve 8.

Figure 2:
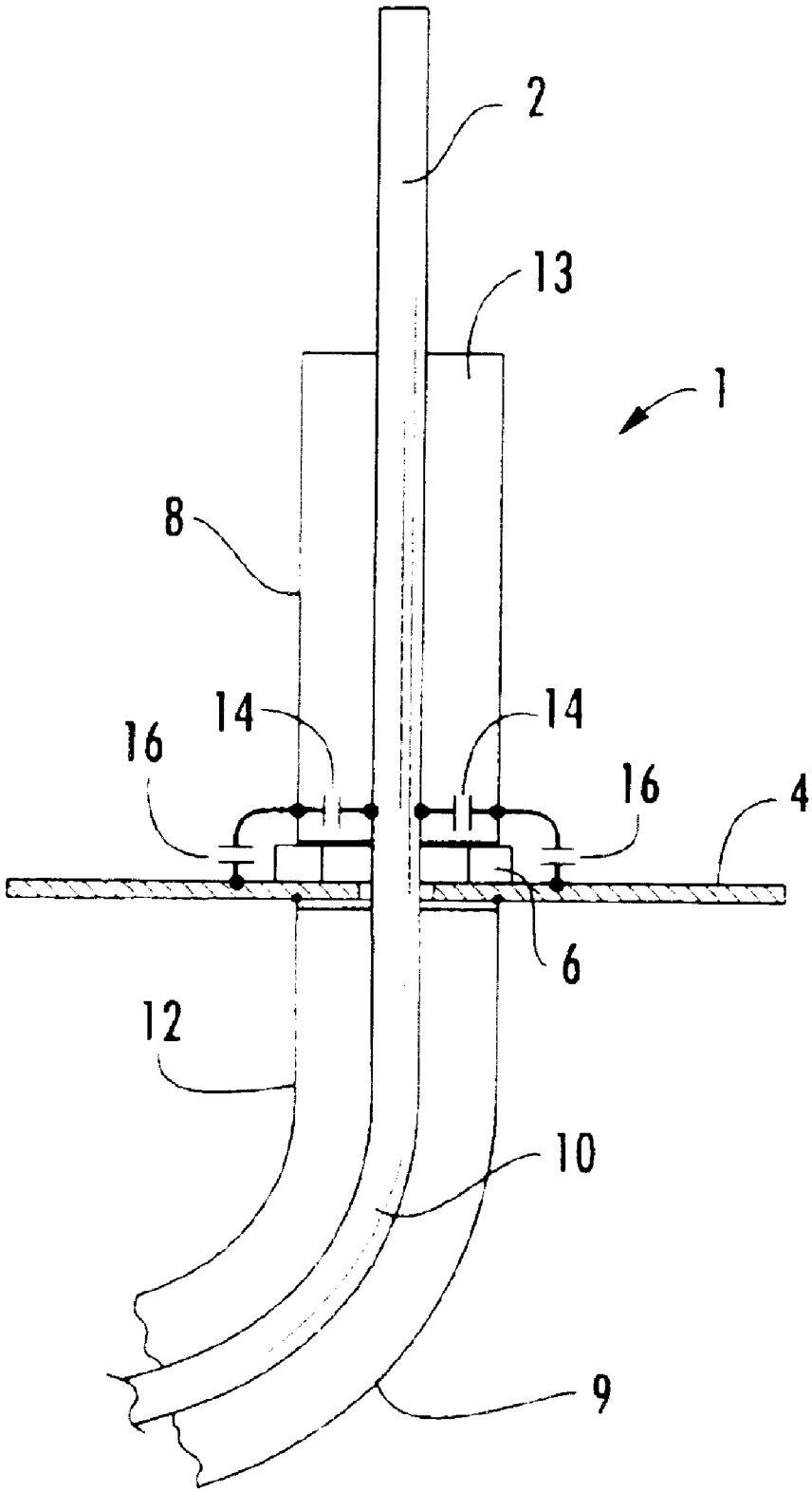
FIG. 2 shows a center section side view of FIG. 1, along with representative electrical couplings related to the sleeve element.

When fed with an RF signal, the sleeve 8 becomes capacitively coupled both to the ground plane 4 and to the antenna element 2 as shown schematically in FIG. 2 by sleeve-antenna capacitive coupling 14 and sleeve-ground plane capacitive coupling 16.

By varying the lengths and diameters of the antenna element 2 and sleeve 8, along with the thickness and or dielectric properties of the dielectric spacer 6 the antenna 1 may be tuned for response to at least 2 target bands. Similarly, the air gap 13 between the sleeve 8 and the antenna element 2 may be filled with a desired dielectric material, allowing further manipulation of the resulting value of the antenna-sleeve capacitive coupling 14 in addition to modification of the associated element dimensions.

A suitable dielectric spacer 6 material is standard printed circuit board substrate. Alternatively, the dielectric spacer 6 may be, for example, a dielectric surface coating, for example PTFE, applied to the ground plane 4 and or sleeve 8.

Applicant has developed configurations wherein the higher target band is more than twice the frequency of the lower target band. Many iterations of the different dimensional variables may be quickly optimized for desired target frequencies by one skilled in the art using method of moments electromagnetic modeling software, available for example from Zeland Software, Inc. of Fremont, Calif., USA.

Figure 3A:
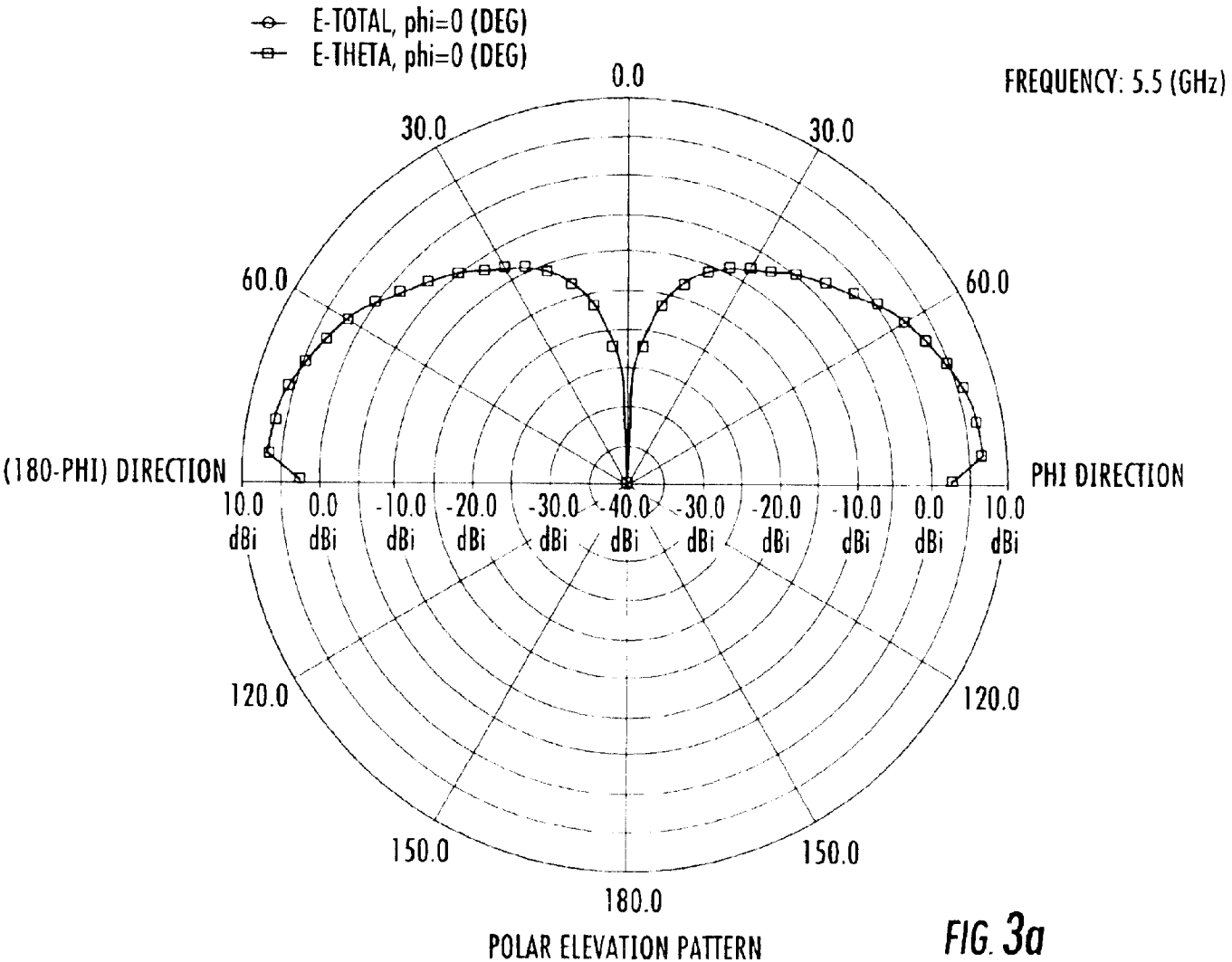
FIG. 3*a* is a 2.4 MHz polar radiation pattern model of the first embodiment.
Figure 3B:
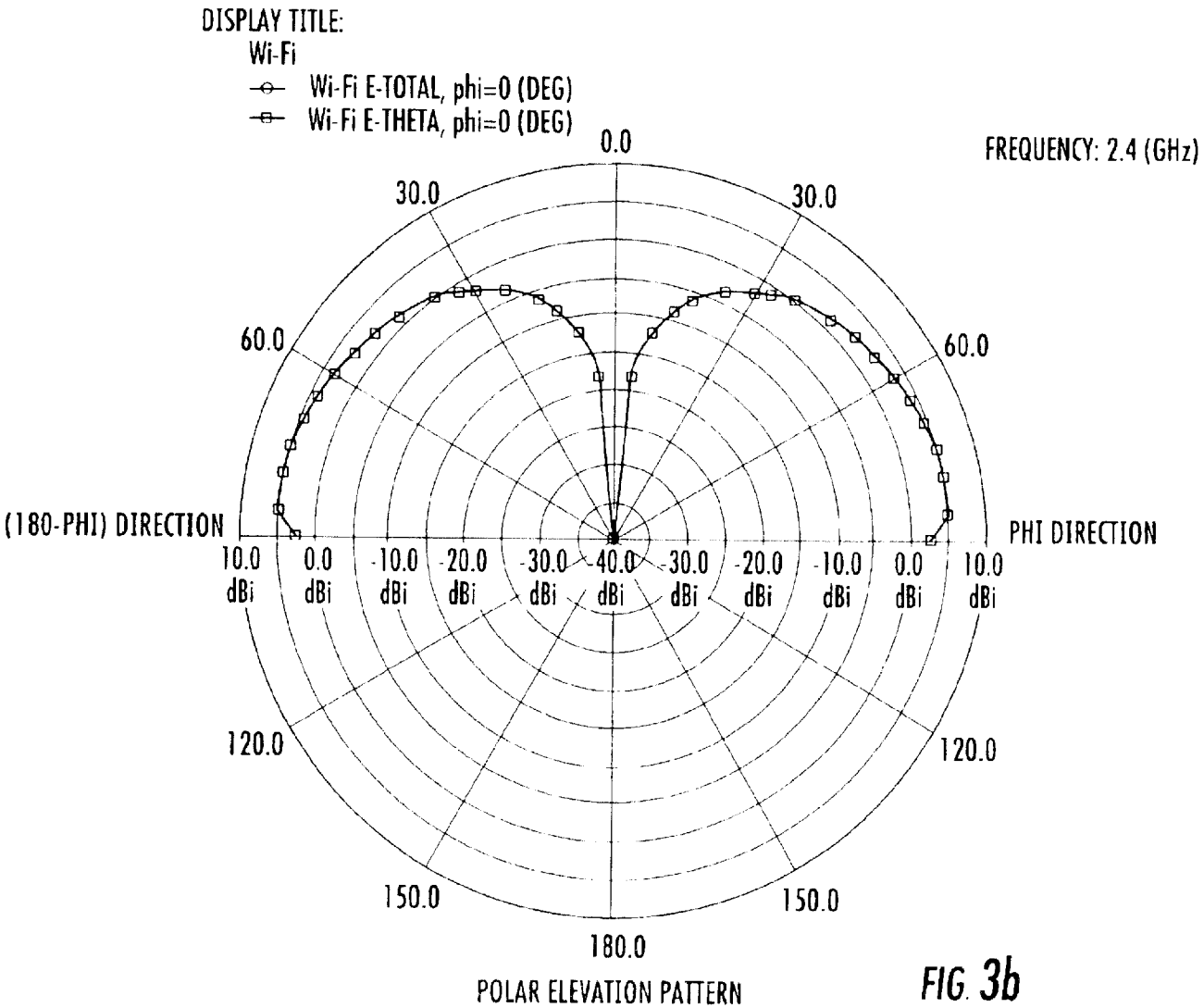
FIG. 3*b* is a 5.5 MHz polar radiation pattern model of the first embodiment.
Figure 4:
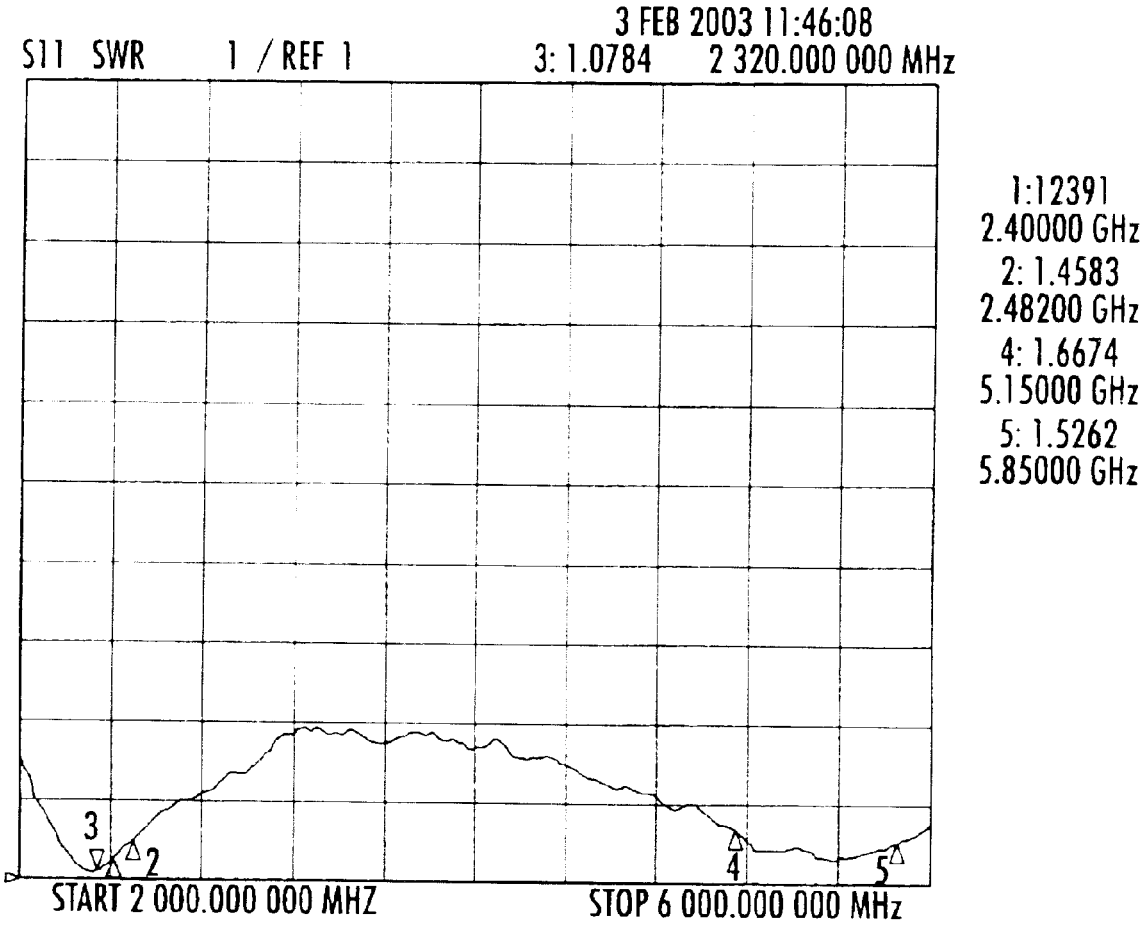
FIG. 4 is test data of standing wave ratios versus frequency, for the first embodiment.

Theoretical models and test data for a first embodiment modeled for dual Wi-Fi frequency bands of approximately 2.4 and 5.5 MHz is shown in FIGS. 3*a*, 3*b*, and 4. Selected dimensions of the antenna 1 for the embodiment shown are as follows: antenna element 2: 29 mm long, 1.6 mm diameter sleeve 8: 15.5 mm long, 7.2 mm diameter-dielectric spacer 6: 0.02" thick, dielectric constant=3.38 As shown by the electrical models and resulting test data, the antenna 1 configuration provides uniform radiation patterns and standing wave ratio performance of less than 1.7 across two non-harmonically related frequency bands. Further, the antenna has a greatly simplified mechanical structure that is cost effective to manufacture from standard, commonly available materials with minimal machining and or metal forming requirements.

Figure 5:
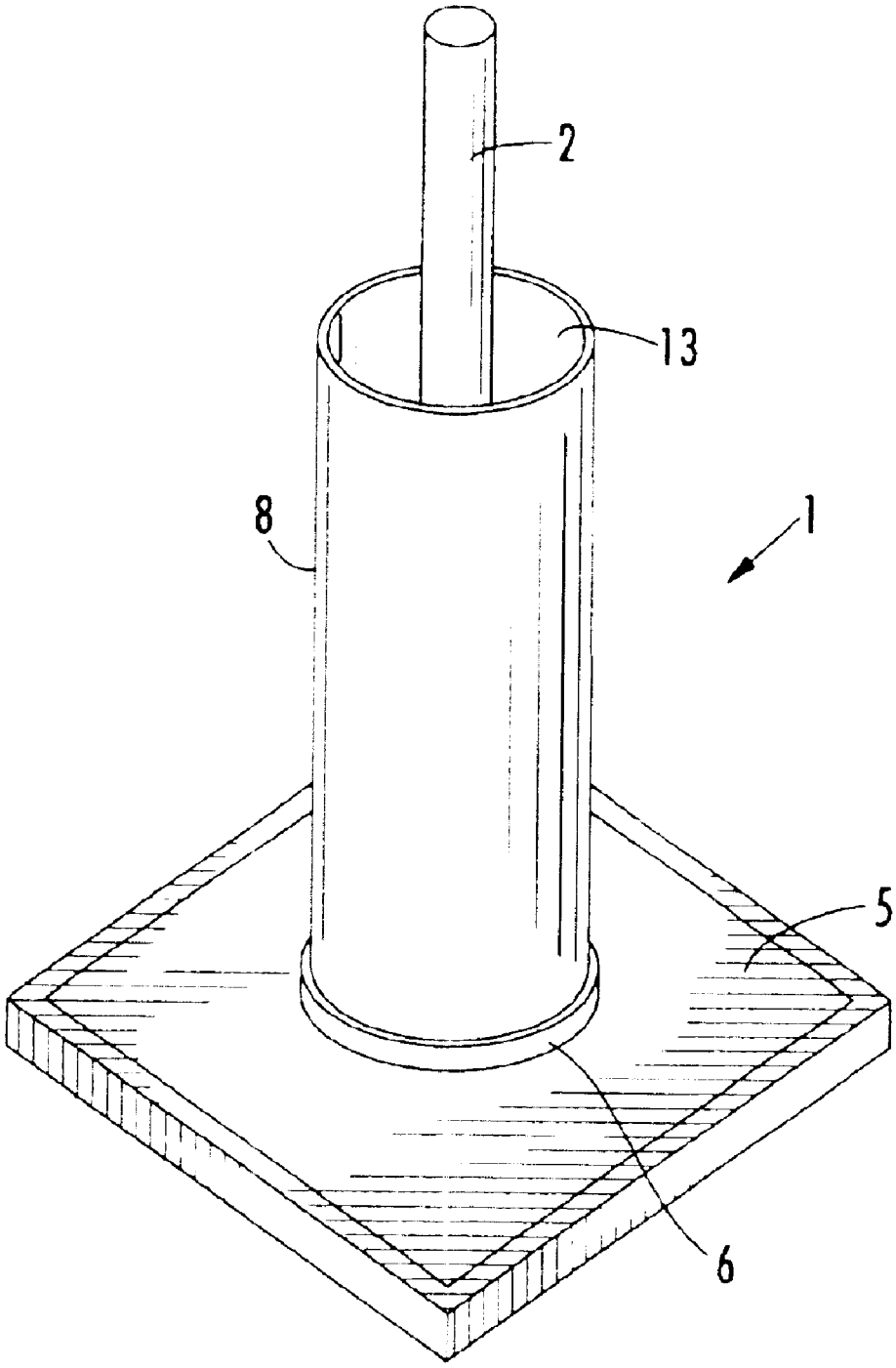
FIG. 5 is an external isometric view of a three band embodiment of the invention wherein the ground plane is a patch element for a second antenna. Antenna feeds and hidden lines omitted for clarity.

The antenna is extremely compact, and may be further integrated with other antenna elements. As shown in FIG. 5, the ground plane 4 described herein may be the radiator of a, for example, GPS or SDAR antenna module formed with a patch antenna element 5, creating a tri-band antenna assembly. Patch antennas and their construction/dimensions for specific frequency bands, being well known in the art, are not further disclosed here. Because the antenna elements are electrically isolated from direct interconnection with the ground plane 4, when the ground plane 4 is a patch antenna element 5, degradation of the patch antenna element 5 operating characteristics, if any, is acceptable.

The antenna has been demonstrated with respect to dual Wi-Fi frequency bands. Alternatively, the antenna dimensions may be designed for different target frequency bands. The antenna element dimensions and spacing being appropriately adjusted to match the midpoint frequencies of the chosen target frequency bands for the best overall performance.

Table of Parts

| | |
|---|---|
| 1 | antenna |
| 2 | antenna element |
| 4 | ground plane |
| 5 | patch antenna element |
| 6 | dielectric spacer |
| 8 | sleeve |
| 9 | coaxial cable |
| 10 | inner conductor |
| 12 | outer conductor |
| 13 | air gap |
| 14 | sleeve-antenna capacitive coupling |
| 16 | sleeve-ground plane capacitive coupling |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A dual-band antenna, configured for operation within two non-harmonically related frequency bands, comprising:

an antenna element extending from a ground plane, the antenna element electrically isolated from the ground plane;

a tubular sleeve, electrically isolated from the ground plane, coaxial with the antenna element; and a dielectric spacer located between the ground plane and the sleeve.

2. The antenna of claim 1, wherein the dielectric spacer has a thickness and dielectric constant selected to create a desired sleeve-ground plane capacitive coupling.

3. The antenna of claim 1, wherein the dielectric spacer is a dielectric coating on one of the ground plane, the sleeve or the ground plane and the sleeve.

4. The antenna of claim 1, wherein an outer diameter of the antenna element and an inner diameter of the sleeve are selected to create a desired sleeve-antenna element capacitive coupling.

5. The antenna of claim 4, wherein a dielectric material is positioned between the sleeve and the antenna element.

6. The antenna of claim 1, wherein the ground plane is a radiating element of a second antenna.

7. The antenna of claim 6, wherein the second antenna is one of a GPS and a SDAR antenna.

8. The antenna of claim 1, wherein the antenna element is the inner conductor of a coaxial cable extending through an aperture in the ground plane; and an outer conductor of the coaxial cable is coupled to the ground plane.

9. The antenna of claim 1, wherein the dual non-harmonically related frequency bands are 802.11a and 802.11b/g Wi-Fi frequency bands.

10. The antenna of claim 1, wherein the dual non-harmonically related frequency bands are a low frequency band and a high frequency band; the high frequency band being more than double the frequency of the lower frequency band.

11. The antenna of claim 1, wherein the antenna element extends less than 35mm from the ground plane.

12. A dual band Wi-Fi antenna, comprising:

an antenna element extending through an aperture in a ground plane, electrically isolated from the ground plane;

a sleeve coaxially surrounding a portion of the antenna element, electrically isolated from the antenna element;

the sleeve spaced away from the ground plane by a dielectric spacer.

13. The antenna of claim 12, wherein the dimensions of the antenna element, sleeve and dielectric spacer are selected to provide the antenna with a standing wave ratio of less than 2 when operated in each of the dual bands.

14. The antenna of claim 12, wherein the sleeve is tubular.

15. The antenna of claim 12, wherein the ground plane is a radiating element of a second antenna.

* * * * *